US010669741B2

(12) United States Patent
Lin

(10) Patent No.: US 10,669,741 B2
(45) Date of Patent: Jun. 2, 2020

(54) CONNECTOR WITH ROTATING LOCK MECHANISM

(71) Applicant: Regal Jewelry Manufacture Co., Ltd., Samutsakorn (TH)

(72) Inventor: Ju-Ying Lin, Taipei (TW)

(73) Assignee: REGAL JEWELRY MANUFACTURE CO., LTD., Samutsakorn (TH)

( * ) Notice: Subject to any disclaimer, the term of this patent is extended or adjusted under 35 U.S.C. 154(b) by 0 days.

(21) Appl. No.: 15/895,867

(22) Filed: Feb. 13, 2018

(65) Prior Publication Data

US 2019/0249458 A1 Aug. 15, 2019

(51) Int. Cl.

| | |
|---|---|
| ***E05B 17/20*** | (2006.01) |
| ***E05B 17/00*** | (2006.01) |
| ***A44C 5/20*** | (2006.01) |
| *E05B 15/04* | (2006.01) |

(52) U.S. Cl.

CPC ..... *E05B 17/20* (2013.01); *A44C 5/2076* (2013.01); *E05B 17/0037* (2013.01); *A44C 5/2066* (2013.01); *E05B 2015/0413* (2013.01)

(58) Field of Classification Search

CPC ..... E05B 17/20; E05B 17/0037; E05B 2015/0413; A44C 5/2066; A44C 5/2076

See application file for complete search history.

(56) References Cited

U.S. PATENT DOCUMENTS

| | | | | | |
|---|---|---|---|---|---|
| 400,511 | A * | 4/1889 | Tainter et al. | A44B 11/2526 | 24/644 |
| 1,807,293 | A * | 5/1931 | Keller | A44C 5/2042 | 24/616 |
| 2,586,758 | A * | 2/1952 | Zerr | A44C 5/2042 | 24/116 A |
| 4,581,904 | A * | 4/1986 | Lehmann | A63H 3/16 | 446/310 |
| 4,881,305 | A * | 11/1989 | Rivera | A44C 5/2047 | 24/616 |
| 4,935,996 | A * | 6/1990 | Ferrara | A44B 11/2596 | 24/33 R |
| 5,008,984 | A * | 4/1991 | Levy | A44C 5/2042 | 24/303 |
| 5,228,317 | A * | 7/1993 | Hendricks | A44C 17/0208 | 63/15.7 |
| 5,678,282 | A * | 10/1997 | Stewart | A44C 5/2066 | 24/574.1 |

(Continued)

*Primary Examiner* — Robert Sandy
*Assistant Examiner* — Louis A Mercado
(74) *Attorney, Agent, or Firm* — Patterson + Sheridan, LLP

(57) ABSTRACT

A connector device includes a connector component and a housing body. The connector component has a connector head. The housing body includes a first body portion and a second body portion. The first body portion has an accommodating space for the connector head. The second body portion is coupled to the first body portion and is rotatably movable with respect to the first body portion, wherein the second body portion has a first position and a second position. When the second body portion rotates to the first position, access in and out of the accommodating space is allowed for the connector head. When the second body portion rotates to the second position, the second body portion blocks the connector head access into or out of the accommodating space.

9 Claims, 4 Drawing Sheets

(56) References Cited

U.S. PATENT DOCUMENTS

| | | | | |
|---|---|---|---|---|
| 5,722,260 | A * | 3/1998 | Mangano | A44C 5/209<br>24/71 J |
| 6,112,373 | A * | 9/2000 | Steinhauer | A44C 5/185<br>24/615 |
| 6,349,453 | B1 * | 2/2002 | Nicoletti | A44C 5/2042<br>24/616 |
| 6,470,708 | B1 * | 10/2002 | Green | A44C 5/2071<br>24/116 A |
| 6,508,080 | B1 * | 1/2003 | Ninomiya | A44C 5/2042<br>24/574.1 |
| 6,729,159 | B2 * | 5/2004 | Rose | A44C 17/0208<br>24/574.1 |
| 8,756,773 | B2 * | 6/2014 | Kienzle | A44C 5/2042<br>24/327 |
| 2001/0045105 | A1 * | 11/2001 | Takessian | A44C 25/00<br>63/29.1 |

* cited by examiner

CONNECTOR WITH ROTATING LOCK MECHANISM

BACKGROUND

Technical Field

The present disclosure generally relates to a connector device; particularly, the present disclosure relates to a connector device that has a rotating lock mechanism.

Description of the Related Art

Traditional connector devices typically have at least two components: a first connector and a second connector. These two connectors may be respectively connected to other objects or structures, but when the first connector is connected to the second connector, the locking mechanism between the first connector and the second connector is typically too simplistic or prone to failure such that the locking mechanism can be easily accidentally unlocked. Therefore, there is a need for a lock mechanism that allows for easy locking and unlocking of the connection between the connectors, but is also secure enough in structural design that would prevent accidental unlocking from occurring.

SUMMARY

It is an objective of the present disclosure to provide a connector device having a rotating lock mechanism that allows for easy but secure locking/unlocking capabilities.

According to one aspect of the disclosure, a connector device is provided. The connector device having a connector component and a housing body. The connector component having a connector head. The housing body having a first body portion and a second body portion. The first body portion having an accommodating space for the connector head. The second body portion is coupled to the first body portion, and is rotatably movable with respect to the first body portion. The second body portion has a first position and a second position. When the second body portion rotates to the first position, access in and out of the accommodating space is allowed for the connector head. When the second body portion rotates to the second position, the second body portion blocks the connector head access into or out of the accommodating space.

DETAILED DESCRIPTION OF THE PREFERRED EMBODIMENT

Embodiments of the present disclosure provide a connector device having a rotating lock mechanism. In the following detailed description, references are made to the accompanying drawings that form a part hereof, and in which are shown by way of illustration specific embodiments or examples. These embodiments are only illustrative of the scope of the present disclosure, and should not be construed as a restriction on the present disclosure. Referring now the drawings, in which like numerals represent like elements through the several figures, aspects of the present disclosure and the exemplary operating environment will be described.

The present disclosure provides a connector device with a rotatable lock mechanism. Preferably, the connector device can be applicable for use in any apparatus requiring a connector or lock. For instance, the connector device can be applicable for jewelry accessories, cables, lock and/or lock devices. However, the connector device of the present disclosure is not restricted or limited to these examples.

Figure 1:
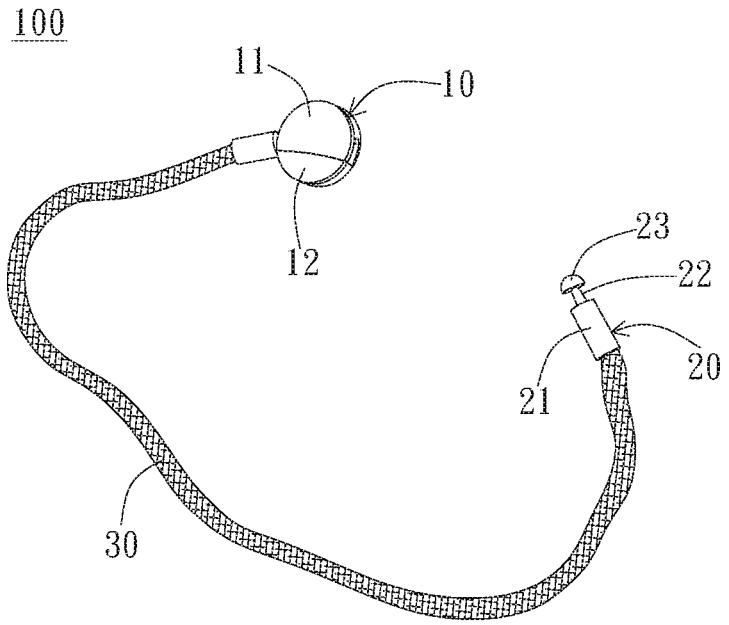
FIG. 1 is a view of an embodiment of the connector device.

FIG. 1 and the following discussion are intended to provide a brief, general description of an exemplary embodiment of the connector device of the present disclosure. However, those skilled in the art will recognize that the embodiments may also be implemented in other suitable environments or devices. Moreover, those skilled in the art will appreciate that the embodiments may also be practiced with other configurations or design alterations.

Referring to FIG. 1, an embodiment of the connector device of the present disclosure. It should be appreciated that although the embodiments described herein are discussed in the context of an jewelry bracelet accessory, the embodiments may be utilized with virtually any other type or form of device or apparatus.

As shown in FIG. 1, the connector device includes a housing body 10 and a connector component 20. The housing body 10 and the connector component 20 can be connected by a cable component 30. In the present embodiment where the connector device is utilized in a bracelet type of jewelry accessory, the cable component 30 can be the chain portion of bracelet. The cable component 30 may be formed of metal, plastic, composite material, or any other types of materials.

Figure 2A:
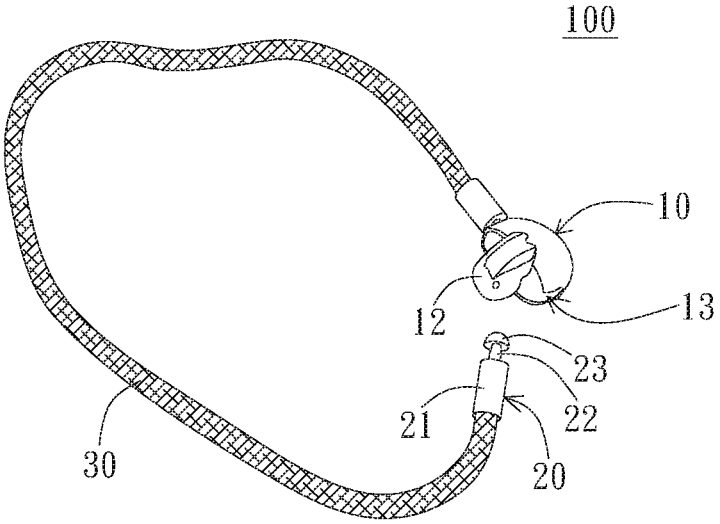
FIG. 2A is an embodiment of the second housing portion rotated relative to the first housing portion of the connector device.
Figure 2B:
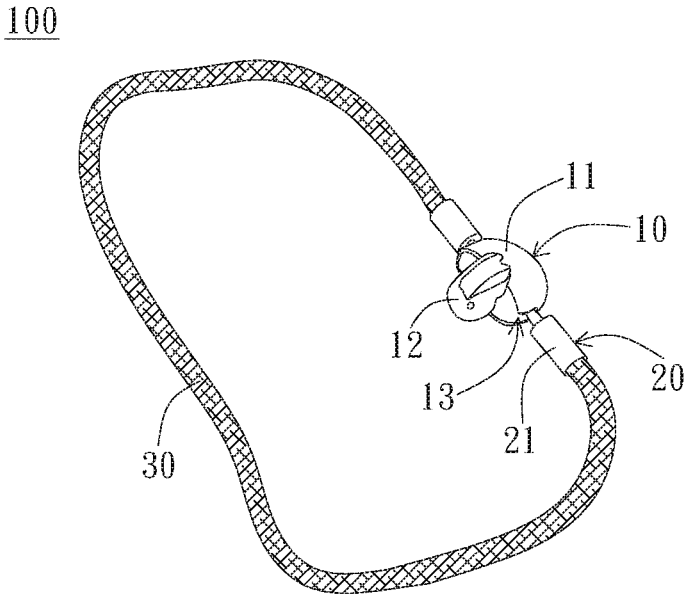
FIG. 2B is another embodiment of FIG. 2A with the connector head portion inserted into the accommodating space of the housing body.
Figure 2C:
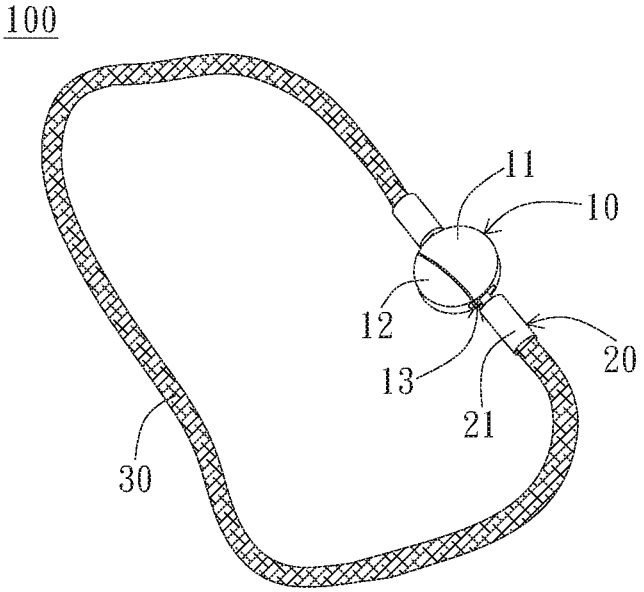
FIG. 2C is another embodiment of FIG. 2B with the second housing rotating back to close access to the accommodating space.

As illustrated in FIG. 1, the housing body 10 has a first body portion 11 and a second body portion 12. In the present embodiment, the second body portion 12 is coupled to the first body portion 11, wherein the second body portion 12 can be rotatably movable with respect to the first body portion 11. FIGS. 2A-2C illustrates embodiments of the second body portion 12 in different positions with respect with the first body portion 11.

FIG. 2A is an embodiment of FIG. 1 where the second body portion 12 is rotated into a first position with respect to the first body portion 11. As shown in FIG. 2A, the second body portion 12 is rotated (in comparison to FIG. 1) roughly 90 degrees with respect to the first body portion 11 such that an accommodating space in the first body portion 11 is exposed.

In the present embodiment, the connector component 20 has a connector body 21 and a connector head 23, wherein the connector head 23 is connected to the connector body 21 through a connector rod 22. The connector head 23 is shaped as a dome or mushroom shape, with the base of the connector head 23 being connected to the connector rod 22. However, in other different embodiments, the connector head 23 can be formed in any other shape or dimension. For instance, the connector head 23 may be in the shape of a rectangular block, a polygonal cylindrical shape, or any other shape. In addition, along the same axis of extension, the diameter of the connector rod 22 is smaller than the diameter of the connector body 21.

FIG. 2B is another embodiment of FIG. 2A, wherein the connector head 23 is inserted into the accommodating space of the first body portion 11. In the present embodiment, the first body portion 11 further includes a slot gap 13 formed on a side of the first body portion 11, wherein the slot gap 13 opens into the accommodating space. When the second body portion 12 is rotated into the first position as shown in FIG. 2B, the connector rod 22 of the connector component 20 is disposed in the slot gap 13 when the connector head 23 is inserted into the accommodating space.

In the present embodiment, the width (shortest distance across the gap) of the slot gap 13 is preferably greater than the diameter of the connector rod 22, but smaller than the diameter of the base surface of the connector head 23. In this manner, when the connector head 23 is disposed in the accommodating space of the first body portion 11, the connector head cannot exit the accommodating space via the slot gap 13.

FIG. 2C is an embodiment of FIG. 2B, wherein the second body portion 12 is rotated back into the second position with respect to the first body portion 11 when the connector head 23 is disposed in the accommodating space of the first body portion 11. In the present embodiment, when the second body portion 12 is rotated into the second position with the connector head 23 in the accommodating space, access into and out of the accommodating space of the first body portion 11 by the connector head 23 (or by any other connector heads) is denied or blocked by the second body portion 12. In other words, when the second body portion 12 is rotated into the second position, the second body portion 12 blocks the opening to the accommodating space of the first body portion 11. Since the dimension of the connector head 23 of the connector component 20 is greater than the slot gap 13, with the second body portion 12 blocking the entrance and exit to the accommodating space of the first body portion, the connector head 23 cannot enter the accommodating space if it is already not disposed in the accommodating space or cannot exit the accommodating space if it is already disposed in the accommodating space.

In the present embodiment, the length of the slot gap 13 is preferably greater than the diameter of the connector rod 22 of the connector component 20. If the length of the slot gap 13 is greater than the diameter of the connector rod 22, the connector component 20 is allowed to slide along the extension of the slot gap 13 when the connector head 23 is disposed in the accommodating space of the first body portion 11. In the present embodiment, only one connector head 23 is disposed in the accommodating space of the first body component 11. In other words, only the connector rod 22 of the only one connector head 23 will be disposed and allowed to slide along the extension of the slot gap 13. However, in other different embodiments, if the length or extension of the slot gap 13 is long enough, multiple connector heads 23 from different connector components 20 may be accommodated in the accommodating space of the first body portion 11 such that their respective connector rods 22 are simultaneously disposed in the slot gap 13.

Figure 3:
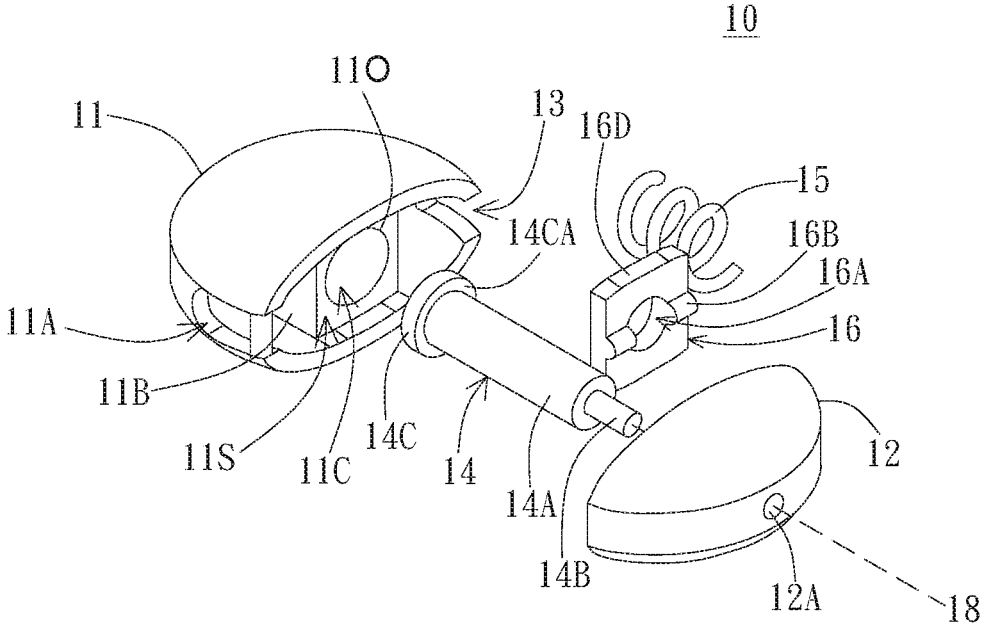
FIG. 3 is an embodiment of the different components of the connector device.

FIG. 3 is another embodiment of FIGS. 1-2C with all of the internal components illustrated (not necessarily assembled together). In the present embodiment, the first body portion 11 and the second body portion 12 is coupled together by an axle rod 14. In the present embodiment, the extending direction of the axle rod 14 is parallel to an axis of rotation 18, wherein one end of the axle rod 14 is connected to the first body portion 11 and the other end of the axle rod 14 is connected to the second body portion 12. In other words, the axis of rotation 18 is defined by the axis of the axle rod 14, wherein the second body portion 12 rotates about the axis of rotation 18 at one end of the axle rod 14.

In the present embodiment, the first body portion 11 may further have a cavity 11C and an opening 11O to the cavity 11C formed on a wall 11S. The axle rod 14 has an axle body 14A extending along the direction of the axis of rotation 18, and the axle body 14A has a first end facing the first body portion 11 and a second end facing the second body portion 12.

As illustrated in FIG. 3, the axle rod 14 further includes a flat disc component 14C disposed at the first end. When coupled to the first body portion 11, the flat disc component 14C is disposed in the cavity 11C. In other words, the opening 11O (to the cavity 11C that is formed on the wall 11S has a diameter that is substantially the same or slightly larger than the diameter of the axle body 14A of the axle rod 14 such that the axle body 14A may fit through the opening 11O when the flat disc component 14C is positioned in the cavity 11C.

In the present embodiment, the disc component has a diameter that is larger than the opening 11O to the cavity 11C such that when the axle rod 14 is pulled in the direction towards the second body portion 12, an inner surface 14CA of the flat disc component 14C facing the second body portion 12 will rest against an inner wall 11I in the cavity around the periphery 11P of the opening 11O. In other words, the inner surface 14CA will rest against the inner wall 11I of the wall 11S, wherein the inner wall 11I will block the movement of the axle rod 14 in the direction towards the second body portion 12.

As illustrated in FIG. 3, the axle rod 14 may further include a cylindrical pin component 14B extending along the direction of the axis of rotation 18 and disposed on the second end of the axle rod 14 away from the first body portion 11. In the present embodiment, the cylindrical pin component 14B has a diameter smaller than the diameter of the axle body 14A, and the cylindrical pin component 14B corresponds to a pin hole 12A of the second body portion 12. The axle rod 14 is coupled or fixed to the second body portion 12 by way of the cylindrical pin component 14B being inserted into the pin hole 12A of the second body portion 12.

Figure 4:
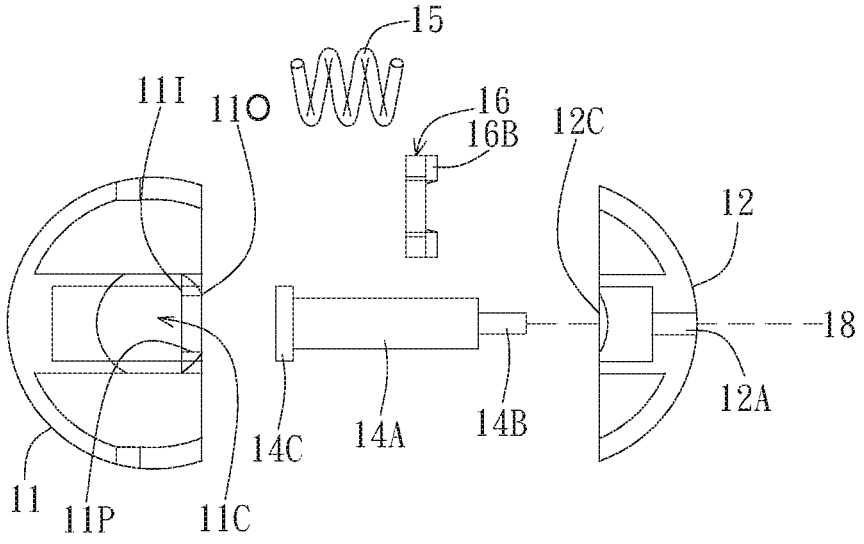
FIG. 4 is a top view of the embodiment of FIG. 3.

FIG. 4 is a top view of a horizontal plane cross-section of the embodiment of FIG. 3. As shown in FIGS. 3 and 4, the connector device may further include a flat block 16, wherein the flat block 16 has a through-hole 16A. In the present embodiment, the flat block 16 is formed in a substantially square or rectangular shape. The diameter of the through-hole 16A is substantially the same or slightly greater than the diameter of the axle body 14A of the axle rod 14. The flat block 16 is disposed on the axle rod 14 with the axle body 14A inserted through the through-hole 16A, as shown in FIGS. 3-5.

Figure 5:
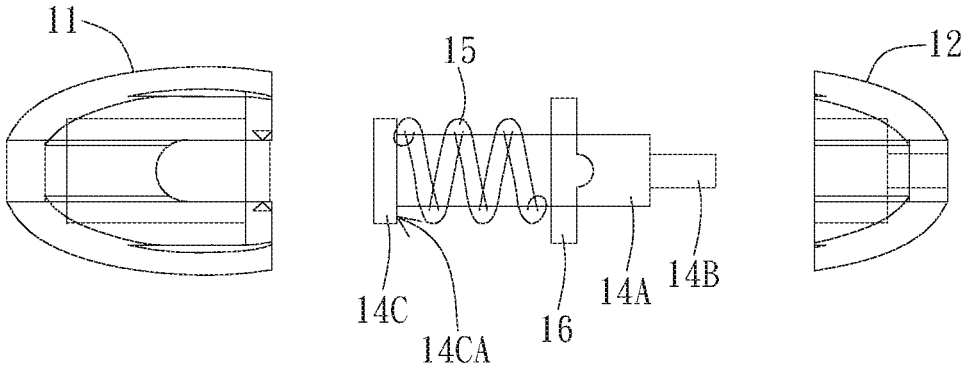
FIG. 5 is a cross-sectional view in the lateral plane along the axis of the axle component of FIG. 3 with the block component and the spring component installed onto the axle component.

As illustrated in FIGS. 3-5, the connector device may further include a spring component 15. In the present embodiment, the spring component 15 is formed in the shape of a coil. The spring component 15 is disposed wrapped around the axle rod 14 with the axis of the spring component 15 being aligned with the axis of rotation 18 of the axle rod 14. When the spring component 15 is disposed wrapped around the axle body 14A of the axle rod 14, the spring component 15 is positioned between the first end of the axle body 14A (closest to the first body portion 11) and the flat block 16.

In the present embodiment, a first end of the spring component 15 is disposed against an outer wall surrounding the periphery of the opening 11O to the cavity 11C of the first body portion 11. In other words, the first end of the spring component 15 is disposed against the outer surface of the wall 11S. The spring component 15 has a second end that is disposed against the surface of the flat block 16 facing the first body portion 11.

As shown in FIGS. 3-5, the flat block 16 has a top side 16D and a bottom side (not shown) opposite the top side 16D. The top side 16D and the bottom side respectively correspond to an inner top surface and an inner bottom surface of the first body portion 11 in front of the opening 11O to the cavity 11C. The generally square or rectangular shape of the flat block 16 insures that when the flat block 16 is disposed with the top side 16D and the bottom side respectively against the inner top surface and inner bottom surface of the first body portion 11, the flat block 16 will not rotate with the second body portion 12 when the second body portion 12 is rotated in relation to the first body portion 11.

In the present embodiment, the flat block 16 may further include at least one ridge 16A that corresponds to at least one recess 12C of the second body portion 12, as shown in FIGS. 3 and 4. When the second body portion 12 is in the second position, the at least one ridge 16A of the flat block 16 will be aligned with the at least one recess 12C of the second body portion 12. In this situation, the at least one ridge 16A will be seated in the at least one recess 12C since the spring component 15 will exert a force on the flat block 15 in the direction towards the second body portion 12. With the at least one ridge 16A seated in the at least one recess 12C of the second body portion 12, the second body portion 12 will be locked in the second position relative to the first body portion 11. A benefit of this design is that if the connector head 23 of the connector component 20 is disposed in the accommodating space of the first body portion 11 when the second body portion 12 is in the second position, the second body portion 12 will be locked in the second position by the ridge 16A being seated in the recess 12C such that there would be no way for the connector component 20 to be decoupled from the housing body 10. In other words, with the ridge 16A seated in the recess 12C and with the spring component 15 continually exerting a force on the flat block 16 in the direction towards the second body portion 12, a secure locking mechanism is formed by the spring component 15, the flat block 16, and the second body portion 12.

In order to decouple or disconnect the connector component 20 from the housing body 10, the second body portion 12 would first need to be rotated to the first position relative to the first body portion 11. In the present embodiment, since the spring component 15 exerts a force on the flat block 16 to keep the ridge 16A seated in the recess 12C when the second body portion 12 is in the second position, substantial force is required to rotate the second body portion 12 into the first position. To unseat the ridge 16A from the recess 12C, as the second body portion 12 is rotated towards the first position, the ridge 16A will ride up the curvature of the recess 12C and force the flat block 16 to compress the spring component 15. The flat block 16 will be displaced closer towards the first end (near the wall 11S of the first body portion 11) of the axle rod 14 as the second body portion 12 is rotated towards the first position. In other words, substantial force is required to rotate the second body portion 12 from the second position toward the first position to unseat the ridge 16A from the recess 12C and cause the flat block 15 to compress the spring component 15 towards the first end of the axle rod 14. With the second body portion 12 rotated to the first position, the access into and out of the accommodating space of the first body portion 11 is granted to the connector head 23 of the connector component 20.

Figure 6:
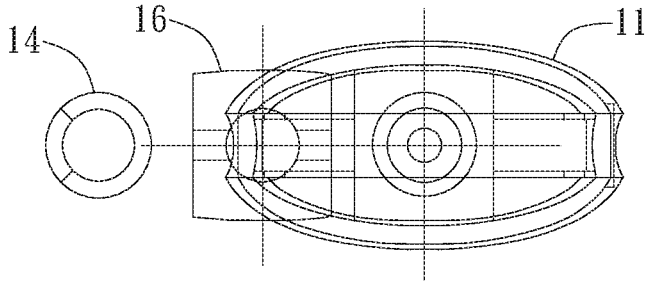
FIG. 6 is a cross-sectional view in the lateral plane perpendicular to the axis of the axle component.

FIG. 6 is a cross-sectional view of the embodiment of FIG. 3 along a plane parallel to the flat block 16. In the present embodiment, the substantially square or rectangular shape of the flat block 16 is in substantially the same shape and dimension of the wall 11S of the first body portion 11. In this manner, the flat block 16, when disposed in the first body portion 11 in front of the wall 11S, can be prevented from being rotated with respect to the first body portion 11.

Although the embodiments of the present disclosure have been described herein, the above description is merely illustrative. Further modification of the embodiments herein disclosed will occur to those skilled in the respective arts and all such modifications are deemed to be within the scope of the disclosure as defined by the appended claims.

What is claimed is:

1. A connector device, comprising:

a connector component having a connector head; and a housing body including:

a first body portion having an accommodating space for the connector head; and a second body portion coupled to the first body portion, the second body portion rotatably movable with respect to the first body portion, wherein the second body portion has a first position and a second position, when the second body portion rotates to the first position, access in and out of the accommodating space is allowed for the connector head, and when the second body portion rotates to the second position, the second body portion blocks the connector head access into or out of the accommodating space, wherein the housing body further includes an axle rod connecting the first body portion and the second body portion, the axle rod having an axis of rotation extending along a length of the axle rod, the second body portion rotating between the first position and the second position around the axis of rotation;

wherein the first body portion further includes a cavity and an opening to the cavity, the axle rod having an axle body extending along a direction of the axis of rotation, the axle body having a first end and a second end opposite to the first end;

wherein the axle rod further includes a flat disc component disposed at the first end and having an inner surface facing the axle rod, the first end of the axle rod is disposed in the first body portion with the axle body inserted through the opening and the flat disc component in the cavity, the inner surface rests against an inner wall in the cavity around a periphery of the opening to block a movement of the axle rod in a direction towards the second body portion.

2. A connector device, comprising:

a connector component having a connector head; and a housing body including:

a first body portion having an accommodating space for the connector head; and a second body portion coupled to the first body portion, the second body portion rotatably movable with respect to the first body portion, wherein the second body portion has a first position and a second position, when the second body portion rotates to the first position, access in and out of the accommodating space is allowed for the connector head, and when the second body portion rotates to the second position, the second body portion blocks the connector head access into or out of the accommodating space, wherein the housing body further includes an axle rod connecting the first body portion and the second body portion, the axle rod having an axis of rotation extending along a length of the axle rod, the second body portion rotating between the first position and the second position around the axis of rotation;

wherein the first body portion further includes a cavity and an opening to the cavity, the axle rod having an axle body extending along a direction of the axis of rotation, the axle body having a first end and a second end opposite to the first end;

wherein the axle rod further includes a single cylindrical pin component extending along the direction of the axis of rotation and disposed only on the second end of the axle rod, a diameter of the cylindrical pin component is smaller than a diameter of the axle body, and the cylindrical pin is inserted into a pin hole of the second body portion to fix the second body portion to the axle rod.

3. A connector device, comprising:

a connector component having a connector head;

a housing body including:

a first body portion having an accommodating space for the connector head; and a second body portion coupled to the first body portion, the second body portion rotatably movable with respect to the first body portion, wherein the second body portion has a first position and a second position, when the second body portion rotates to the first position, access in and out of the accommodating space is allowed for the connector head, and when the second body portion rotates to the second position, the second body portion blocks the connector head access into or out of the accommodating space, wherein the housing body further includes an axle rod connecting the first body portion and the second body portion, the axle rod having an axis of rotation extending along a length of the axle rod, the second body portion rotating between the first position and the second position around the axis of rotation; and a flat block having a through-hole, the flat block is disposed on the axle rod with the axle rod inserted through the through-hole.

4. The connector device of claim 3, further including a spring component, wherein the axle rod has an axle body extending along a direction of the axis of rotation, the axle body having a first end and a second end opposite to the first end, the first end is disposed closer to the first body portion than the second end, the spring component is disposed wrapped around the axle rod with an axis of the spring component being aligned with the axis of rotation of the axle rod, and the spring component is between the first end and the flat block.

5. The connector device of claim 4, wherein the first body portion further having a cavity and an opening to the cavity, the axle rod is disposed partially in the cavity through the opening, and a first end of the spring component is disposed against an outer wall surrounding a periphery of the opening, and a second end of the spring component is disposed against a first surface of the flat block facing the opening.

6. The connector device of claim 4, wherein the flat block has at least one ridge formed on a second surface facing the second body portion, and the second body portion has at least one recess corresponding to the at least one ridge.

7. The connector device of claim 6, wherein when the second body portion is in the second position, the at least one ridge is seated in the at least one recess; when the second body portion is in the first position, the at least one ridge is unseated from the at least one recess.

8. The connector device of claim 6, wherein the spring component exerts a force on the flat block to keep the at least one ridge seated in the at least one recess when the second body portion is in the second position, wherein substantial force is required to rotate the second body portion from the second position toward the first position to unseat the at least one ridge from the at least one recess and cause the flat block to compress the spring component towards the first end of the axle rod.

9. The connector device of claim 8, wherein the at least one ridge presses against a surface of the second body portion around the at least one recess to cause the flat block to be displaced along the axle rod towards the first body portion and compress the spring component.

* * * * *